US009355625B1

(12) United States Patent
Takegawa

(10) Patent No.: US 9,355,625 B1
(45) Date of Patent: May 31, 2016

(54) CYMBAL MOUNTING ASSEMBLY

(71) Applicant: Pearl Musical Instrument Co., Chiba (JP)

(72) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 15/014,065

(22) Filed: Feb. 3, 2016

Related U.S. Application Data

(60) Provisional application No. 62/114,293, filed on Feb. 10, 2015.

(51) Int. Cl.
*G10D 13/02* (2006.01)
*G10D 13/06* (2006.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS 3,336,827 A * 8/1967 Gaylor ..... G10D 13/06 84/422.3
4,319,514 A * 3/1982 Donohoe ..... G10D 13/06 84/421
4,365,535 A * 12/1982 Buttner ..... G10D 13/06 248/412
4,458,574 A * 7/1984 Hoshino ..... G10D 13/065 84/422.3
4,960,028 A 10/1990 Ramirez
6,212,917 B1 * 4/2001 Rathbun ..... D06B 5/16 242/597.4
6,884,015 B1 * 4/2005 Takegawa ..... G10D 13/06 411/287
6,930,233 B2 8/2005 Hsieh
7,479,593 B1 1/2009 Townsend
7,629,526 B1 * 12/2009 Miyajima ..... G10D 13/06 84/422.1
8,288,639 B2 * 10/2012 Carraro ..... G10D 13/06 84/421
8,436,240 B1 * 5/2013 Coady ..... F16B 5/0266 84/327
8,471,133 B1 * 6/2013 Lin ..... G10D 13/06 84/421
2006/0027072 A1 * 2/2006 Morelli ..... G10D 13/06 84/422.3
2013/0136532 A1 * 5/2013 Liao ..... F16B 2/16 403/327
2013/0319205 A1 * 12/2013 Meadows ..... G10D 13/06 84/453

* cited by examiner

*Primary Examiner* — Robert W Horn
(74) *Attorney, Agent, or Firm* — Manelli Selter PLLC; Edward J. Stemberger

(57) ABSTRACT

A cymbal mounting assembly is provided. The cymbal mounting assembly includes a cymbal mounting shaft having an annular groove formed in an outer surface of the cymbal mounting shaft. The cymbal mounting shaft is configured to receive a cymbal. In addition, the cymbal mounting assembly includes a quick release locking mechanism removably coupled to the shaft. The quick release locking mechanism includes a quick release locking mechanism housing and a pair of locking elements. Each locking element includes a distal release portion and a proximal coupling portion. The proximal coupling portion of each locking element engages the annular groove of the shaft when the quick release locking mechanism is in a locked position.

22 Claims, 8 Drawing Sheets

CYMBAL MOUNTING ASSEMBLY

FIELD

The present invention is directed to a connector for a percussive instrument such as a cymbal, and more particularly, to an improved mounting assembly which enables for a quick release and/or mounting of the percussive instrument to an instrument stand.

BACKGROUND

A drum kit includes various percussive musical instruments such as drums, cymbals, etc. Generally, each instrument is mounted on a stand to allow for adequate resonance to project sound. For example, a cymbal can be mounted to a Hi-Hat stand shaft using a securing element such as a wing nut, where the securing element is disposed above the cymbal. However, the wing nut can be over-tightened to the point where it undesirably alters the resonance of the cymbal. In addition, if the cymbal needs to be changed quickly or disassembled, unthreading the wing nut may take significant time and effort that can cause undesirable delays, for example, during a performance or during set-up and take-down.

Various quick release assemblies have been proposed to improve ease and speed of release and/or mounting of a cymbal from an instrument stand. For example, U.S. Pat. No. 4,960,028 proposes a quick-release fastener having a pair of split flanges that provide a biasing force on a sleeve member to secure the quick-release fastener to the mounting shaft of an instrument stand above a cymbal. U.S. Pat. No. 6,930,233 proposes a fast release clamp having a top pressing member removably coupled to an instrument stand using an assembly block where a cymbal is disposed between the top pressing member and the assembly block. The cymbal is secured in place by aligning the top pressing member through an opening formed in the cymbal where the cymbal is secured to the instrument stand using a force applied by a c-shaped clamp of the assembly block that engages with an outer periphery of a portion of the top pressing member. U.S. Pat. No. 7,479,593 proposes a quick release cymbal locking device including an elongated body that is slidably engaged over an end of an instrument stand after a cymbal is mounted on the instrument stand. The locking device further includes a spring biased release arm to provide pivotal engagement of the release arm to the shaft of the instrument stand. U.S. Patent Application Pub. No. 2013/0136532 proposes a cymbal quick-release structure having a fastening cap that engages with a spindle. A latch ball mounted within a coupling ring of the fastening cap removably engages with a groove formed in the spindle to secure a cymbal to an instrument stand.

However, the prior quick release assemblies are prone to deterioration over time and with repeated use can undesirably affect the resonance and sound of the cymbal.

Therefore a need exists for a percussive quick release connector that improves upon prior quick release assemblies and solves the problems inherent in known quick release assemblies.

SUMMARY

An aspect of an embodiment provides a cymbal mounting assembly. The cymbal mounting assembly includes a cymbal mounting shaft having an annular groove formed in an outer surface of the cymbal mounting shaft. The cymbal mounting shaft is configured to receive a cymbal. In addition, the cymbal mounting assembly includes a quick release locking mechanism removably coupled to the shaft. The quick release locking mechanism includes a housing and a pair of locking elements movable with respect to the housing. Each locking element includes a distal release portion and a proximal coupling portion. The proximal coupling portion of each locking element can engage the annular groove formed in the outer surface of the shaft when the quick release locking mechanism is in a locked position.

In accordance with another aspect of an embodiment, a method of releasably mounting a cymbal with respect to a cymbal mounting shaft provides a cymbal mounting assembly having a cymbal mounting shaft including an annular groove formed in an outer surface of the mounting shaft and a shaft bore through the mounting shaft. A positioning device is coupled to the mounting shaft so as to be adjustable along an axis of the mounting shaft. A cymbal is provided on the outer surface of the mounting shaft so as to be generally adjacent to the positioning device. A quick release locking mechanism including a housing with a housing bore therethrough and including locking structure having a proximal coupling portion and a distal release portion. The quick release locking mechanism is releasably coupled to the mounting shaft so that the cymbal is secured between the positioning device and the quick release locking mechanism with the proximal coupling portion being disposed in the annular groove defining a locked position of the locking structure preventing the quick release locking mechanism from moving along the axis of the mounting shaft, wherein manual movement of the locking structure away from the annular groove permits the quick release locking mechanism to move from the locked position and be disengaged from the mounting shaft.

Other aspects of the invention, including apparatus, articles, methods, systems, assemblies, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description, serve to explain the principles of the invention. In such drawings.

DETAILED DESCRIPTION

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
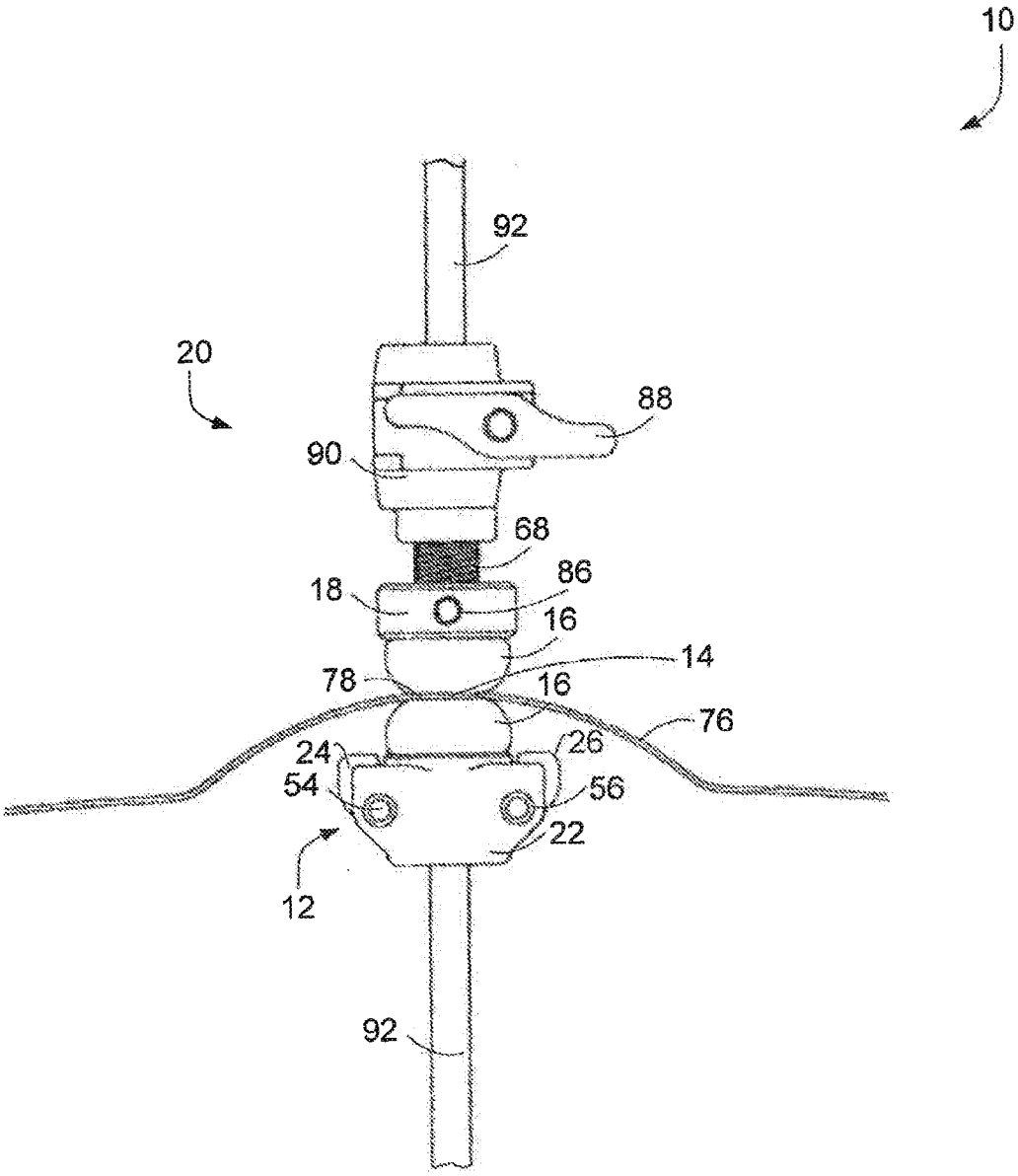
FIG. 1 is a side elevational view of an exemplary cymbal mounting assembly securing a cymbal according to an exemplary embodiment of the present disclosure.

FIGS. 1-4 illustrate a cymbal mounting assembly 10 according to an exemplary embodiment. As best illustrated in FIG. 1, cymbal mounting assembly 10 includes a quick release locking mechanism 12, a cymbal mounting shaft 14, cymbal supports 16, a positioning device 18, and an assembly connector 20.

The quick release locking mechanism 12 includes a housing 22 and a pair of locking elements 24, 26. As best illustrated in FIG. 1, the quick release locking mechanism housing 22 has an elongated body in the transverse direction. However, the housing 22 can have any shape or configuration. The quick release locking mechanism housing 22 can be made of various materials such as plastic, metal, or a combination thereof. The quick release locking mechanism housing 22 can be cast or molded into a single structure or a plurality of separate portions can be fastened together to form the quick release locking mechanism housing 22.

Figure 3:
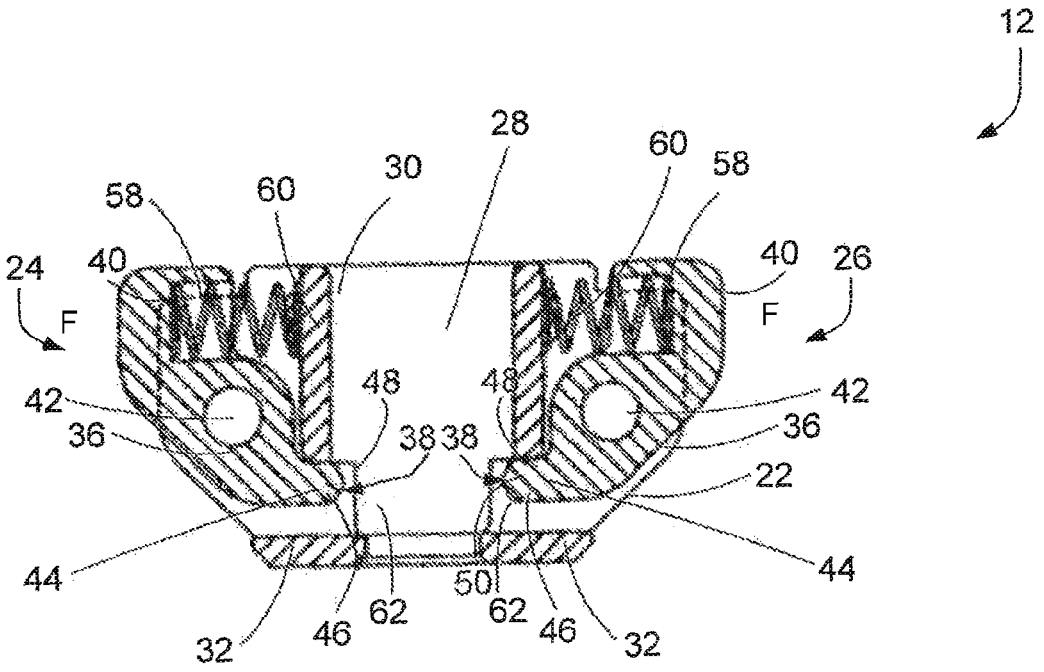
FIG. 3 is a cross-sectional view of a quick release locking mechanism of the cymbal mounting assembly of FIG. 2.

As best illustrated in FIG. 3, a bore 28 is formed in the quick release locking mechanism housing 22 where a shaft receiving wall 30 surrounds the bore 28. In an exemplary embodiment, a flange 32 is formed in the housing 22 where the flange 32 is configured to contact a surface 34 of the cymbal mounting shaft 14. It is noted that the surface 34 of the cymbal mounting shaft 14 is illustrated as contacting the flange 32 in FIG. 4. Likewise, the first portion 70 of the cymbal mounting shaft 14 and the shaft receiving wall 30 are also illustrated as being in contact. However, one of ordinary skill in the art would recognize that the surface 34 of cymbal mounting shaft 14 can alternatively be spaced away from flange 32 and the first portion 70 of the cymbal mounting shaft 14 can be spaced away from the shaft receiving wall 30.

While quick release locking mechanism housing 22 is illustrated in FIG. 1 as being arranged below the assembly connector 20, quick release locking mechanism housing 22 can be arranged above the assembly connector 20 in other embodiments. As illustrated in FIG. 1, when the quick release locking mechanism housing 22 is arranged below the assembly connector 20, instrument stand shaft 92 extends through the opening formed in an upper surface of the quick release locking mechanism housing 22 and the bore 28 as well as through the cymbal mounting shaft 14 and the assembly connector 20, as explained more fully below.

Figure 4:
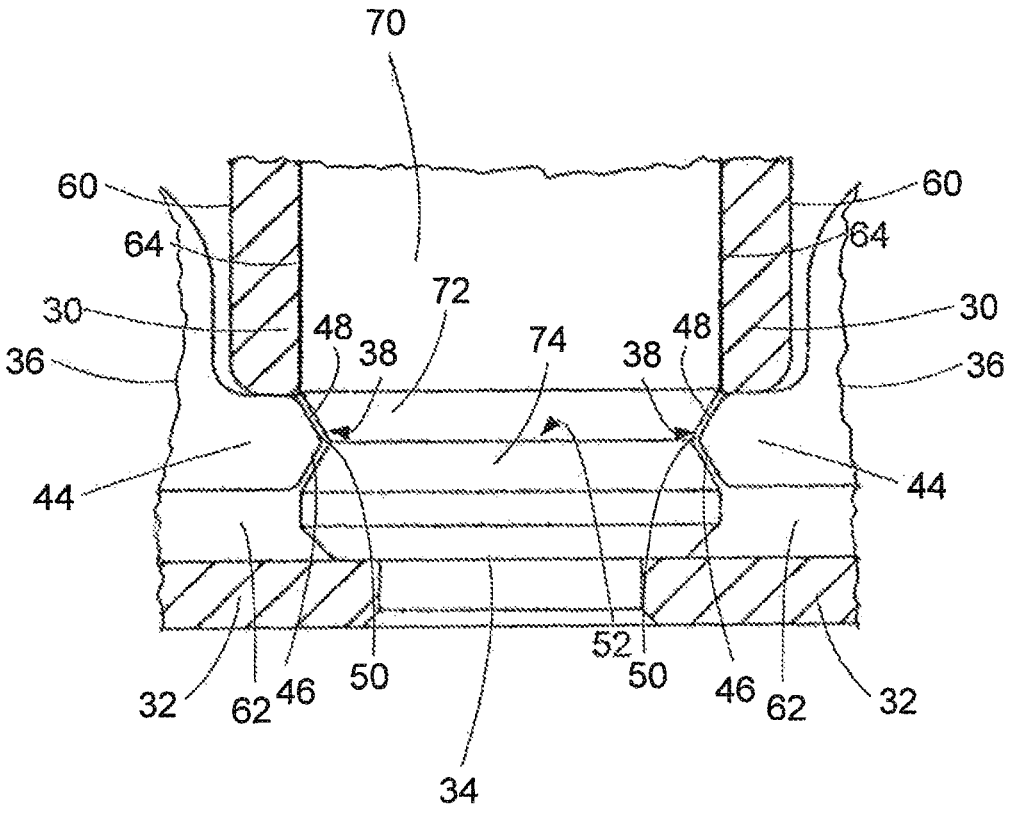
FIG. 4 is a magnified portion of the quick release locking mechanism of FIG. 3 shown locking with a portion of a cymbal mounting shaft.
Figure 5:
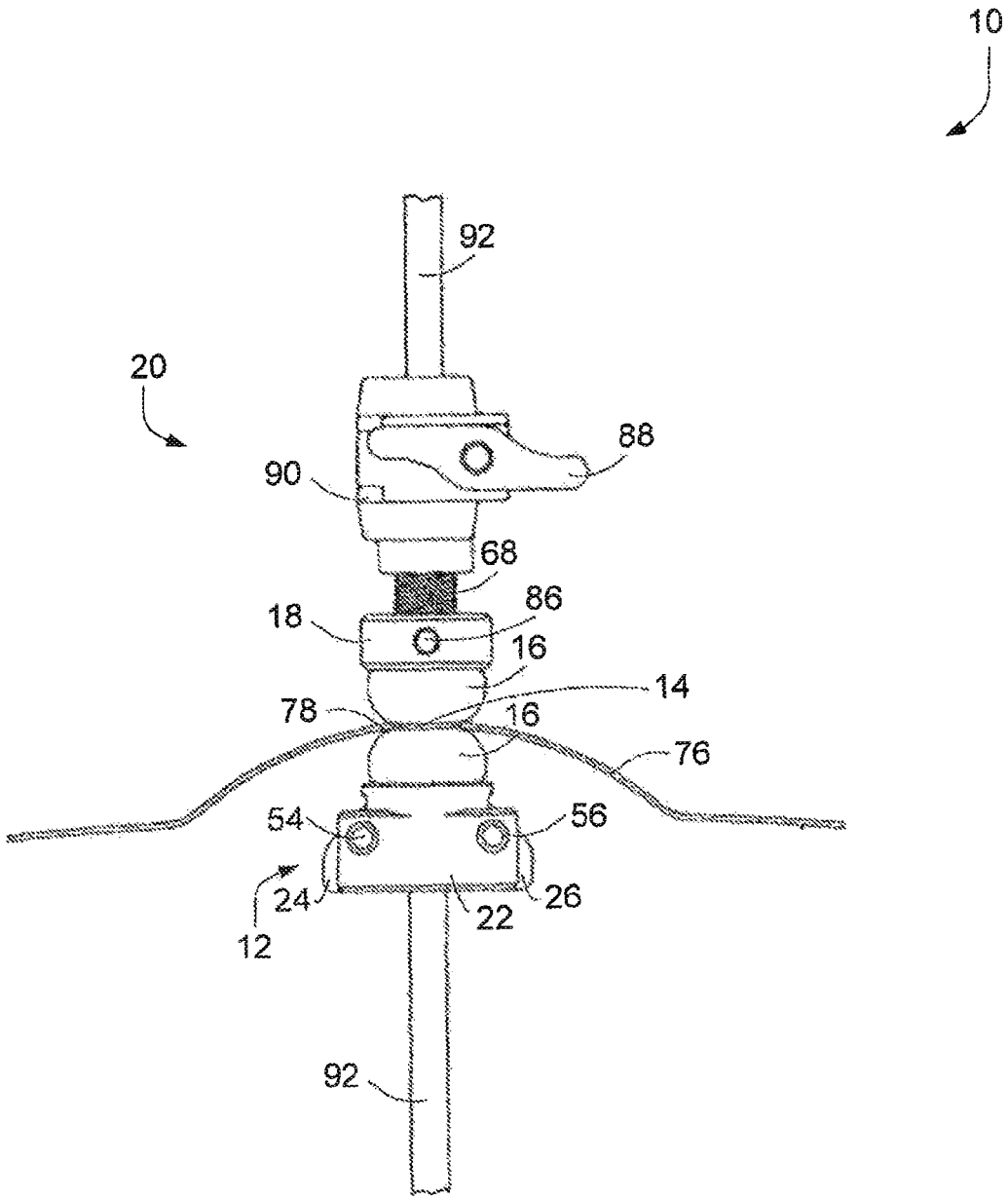
FIG. 5 is a side elevation view of an exemplary cymbal mounting assembly according to another exemplary embodiment of the present disclosure and shown securing a cymbal.

As best illustrated in FIG. 3, locking structure is provided, preferably comprising a first locking element 24 and a second locking element 26, each including a locking arm 36 having a proximal coupling portion 38, a distal release portion 40, and a through-hole 42 formed in the locking arm 36, respectively. Each proximal coupling portion 38 can include a protrusion 44. In an exemplary embodiment, as illustrated in FIG. 4, the protrusion 44 of each proximal coupling portion 38 includes a first angled surface 46 and a second angled surface 48 where the first angled surface 46 and the second angled surface 48 form an apex 50 that fits within an annular groove 52 formed in the cymbal mounting shaft 14. However, the protrusion 44 can have any other shape such as a rounded surface, a flat surface, combination thereof, etc.

The locking arm 36 of each locking element 24, 26 can be manufactured as a single structure or a plurality of structures coupled together. Each locking element 24, 26 is pivotally mounted within the quick release locking mechanism housing 22 using a pin 54. For example, a pin 54 (FIG. 2) is secured through an opening 56 in the housing 22 and through the through-hole 42 formed in the locking arm 36 of the locking element 24, 26. As best illustrated in FIG. 3, a compression spring 58 is engaged with an outside surface 60 of the shaft receiving wall 30 and with an associated portion 40 of each locking element 24, 26. The compression spring 58 provides a biasing force to the corresponding locking arm 36 such that the proximal coupling portion 38 (protrusion 44) remains engaged with the annular groove 52 when the quick release locking mechanism 12 is in the locked position. As used herein, "engaged with the annular groove" means "disposed within the annular groove" and can be construed to mean in contact with surfaces defining the annular groove or directly adjacent to the surfaces defining the annular groove without complete contact therewith. When a force F is applied to the distal release portion 40 of the locking arm 36, the compression spring 58 is compressed and the locking arm 36 rotates around the pin 54 causing the proximal coupling portion 38 to recess within an opening 62 in the shaft receiving wall 30 of the housing 22, away from the annular groove 52 to an unlocked position. Although a pair of locking elements 24, 26 is preferred, the locking structure can include a single locking element having a proximal coupling portion 38 and a distal release portion 40, with the coupling portion 38 being at least partially annular to be received in the annular groove 52.

The cymbal mounting shaft 14 is coupled to the assembly connector 20 and includes the annular groove 52 formed in an outer surface 64 of a first portion 70 of the shaft 14, a reduced diameter portion 66, and a threaded portion 68. Cymbal mounting shaft 14 can be integral with the assembly connector 20 or it can be a separate member that is permanently or removably coupled to the assembly connector 20. The first portion 70 of the cymbal mounting shaft 14 has a first diameter. In an exemplary embodiment, as best illustrated in FIG. 4, the annular groove 52 can include a first angled surface 72 and a second angled surface 74 such that the annular groove 52 has a V-shape. However, the walls of the annular groove 52 can have any shape such as rounded, planar, combination thereof, etc.

Figure 6:
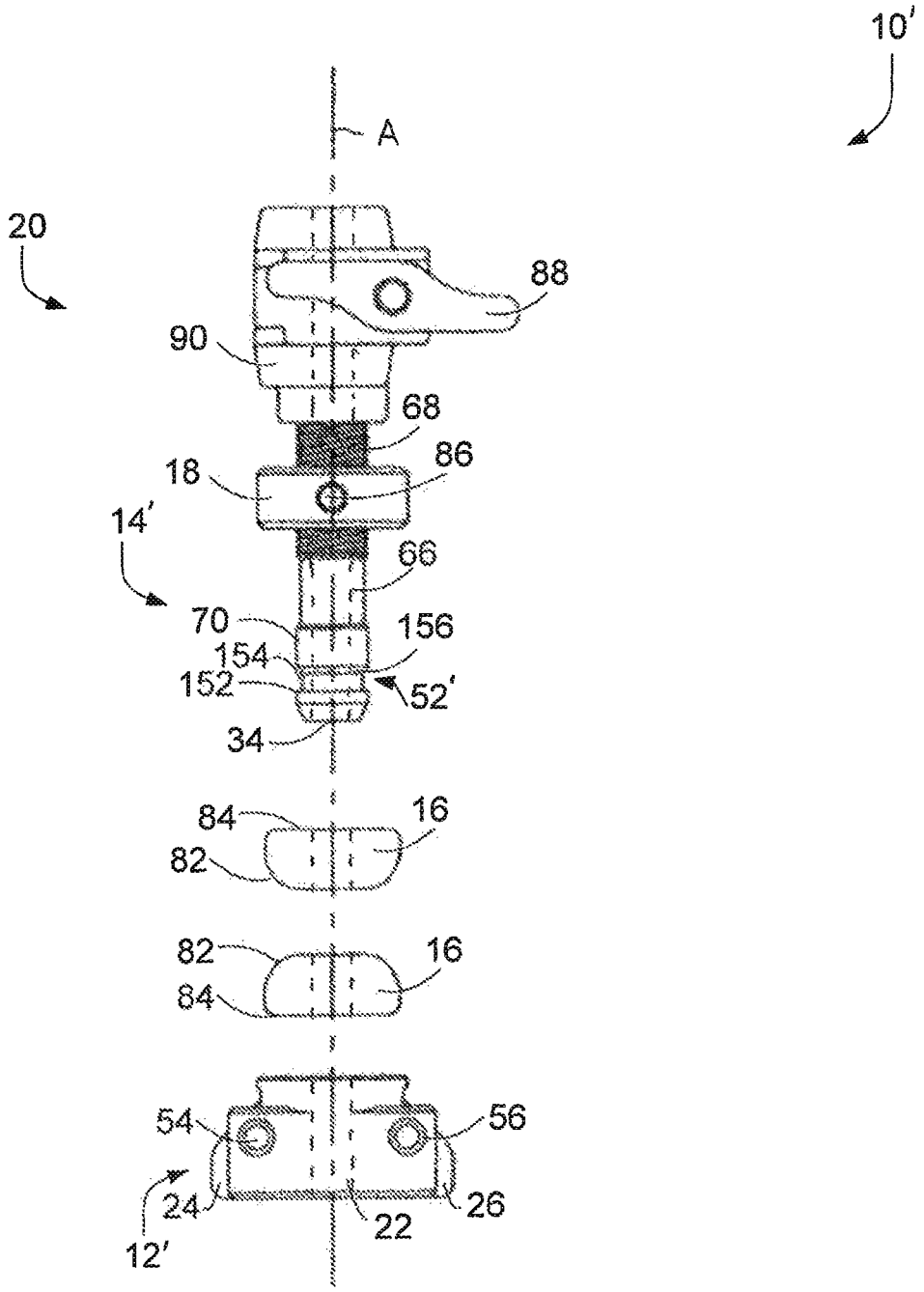
FIG. 6 is an exploded view of the cymbal mounting assembly of FIG. 5.
Figure 7:
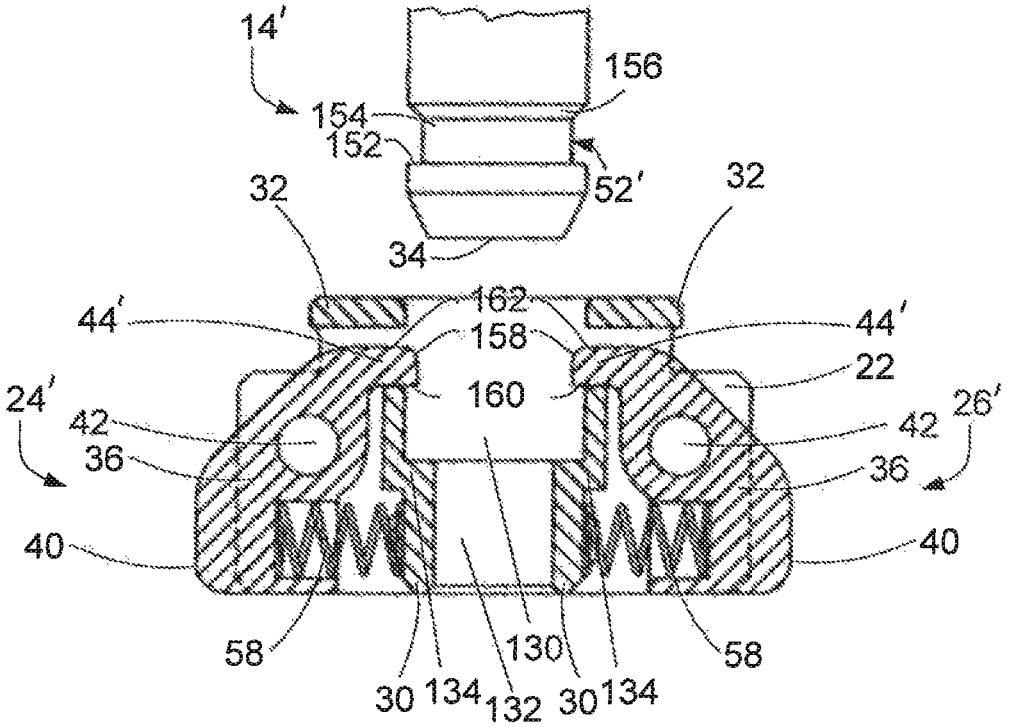
FIG. 7 is a cross-sectional view of the quick release locking mechanism of the cymbal mounting assembly of FIG. 6.
Figure 8:
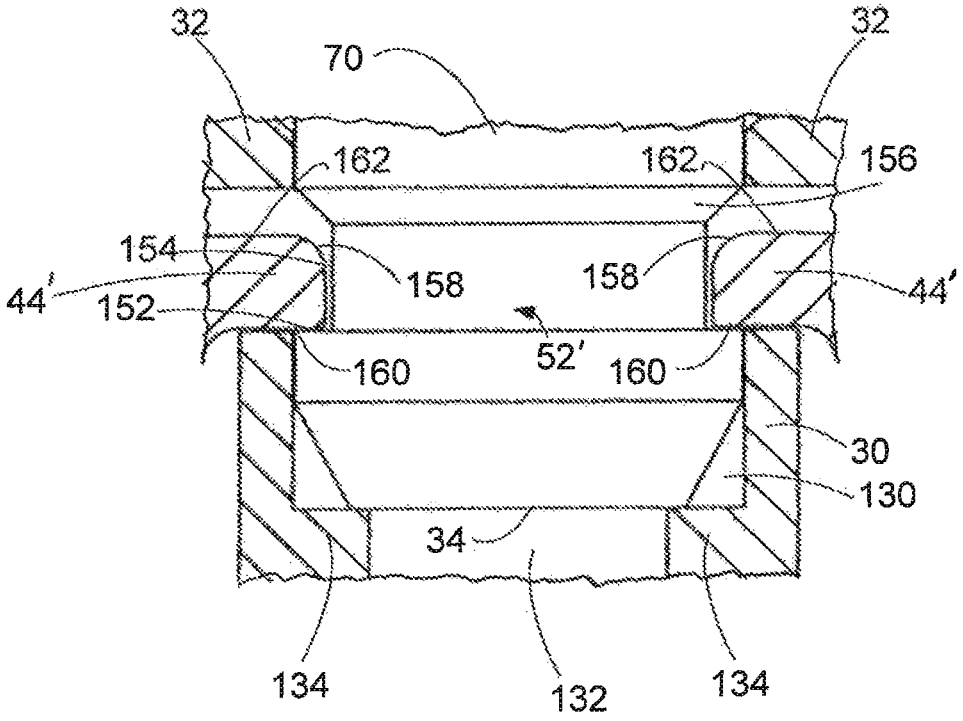
FIG. 8 is a magnified portion of the quick release locking mechanism of FIG. 7 shown locking with a cymbal mounting shaft.

Moreover, the annular groove 52 does not have to be symmetrical about the axial direction of the cymbal mounting shaft 14. For example, as illustrated in FIGS. 6-8, another embodiment of the annular groove 52' formed in the cymbal mounting shaft 14 can include a first wall 152, a second wall 154, and a third wall 156 where the first wall 152 is substantially perpendicular to the second wall 154 and the third wall 156 is angled with respect to the second wall 154. One of ordinary skill in the art would recognize that the overall shape of the annular groove 52 and each wall of the annular groove can have any shape and/or arrangement such that the proximal coupling portions 38 of the locking elements 24, 26 of the quick release locking mechanism 12 directly couple within the annular groove 52 to prevent the quick release locking mechanism housing 22 from disengaging from the cymbal mounting shaft 14.

Returning to FIG. 4, the first portion 70 of the cymbal mounting shaft 14 has a smooth outer surface where the annular groove 52 is formed in the smooth outer surface. One of ordinary skill in the art would recognize that the first portion 70 of the cymbal mounting shaft 14 does not include a threaded portion and the quick release locking mechanism 12 is coupled with the annular groove 52 such that the quick release locking mechanism 12 is coupled to the cymbal mounting shaft 14 without using threaded engagement.

It is noted that conventional cymbal locking devices generally use threading on both a cymbal locking clutch and a mounting shaft to secure a cymbal onto an instrument stand.

Due to the vibrations caused by striking the cymbal, conventional threaded cymbal locking devices become loosened during the performance because the force causes the cymbal locking clutch to unthread from the mounting shaft causing the resulting sound of the cymbal to be undesirable affected. In contrast, the protrusions 44 of the quick release locking mechanism housing 22, as described herein, engage the groove 52 formed in the first portion 70 of the cymbal mounting shaft 14. The forces applied to the locking elements 24, 26 from the compression spring 58 are generally greater than the force caused by the vibrations of the cymbal 76 thereby reducing the likelihood of the protrusions 44 disengaging from the groove 52 when a force is applied to the cymbal 76.

The reduced diameter portion 66 is disposed between the first portion 70 of the cymbal mounting shaft 14 and the threaded portion 68 where the reduced diameter portion has a second diameter less than the first diameter of the first portion 70 of the cymbal mounting shaft 14. The reduced diameter portion 66 has a smooth outer surface and is configured to receive at least a portion of a cymbal 76 when a cymbal 76 is mounted on the cymbal mounting shaft 14. The reduced diameter portion 66 is configured to allow the cymbal 76 to resonate. For example, when the cymbal 76 is mounted onto the cymbal mounting shaft 14, the opening 78 formed in the cymbal 76 is associated with at least a portion of the reduced diameter portion 66 of the shaft 14 to create resonance after the cymbal 76 is struck with a force. It is noted that while cymbal 76 is illustrated in FIG. 1 includes a dome shape, the cymbal 76 may be of any size or shape such as planar.

Figure 2:
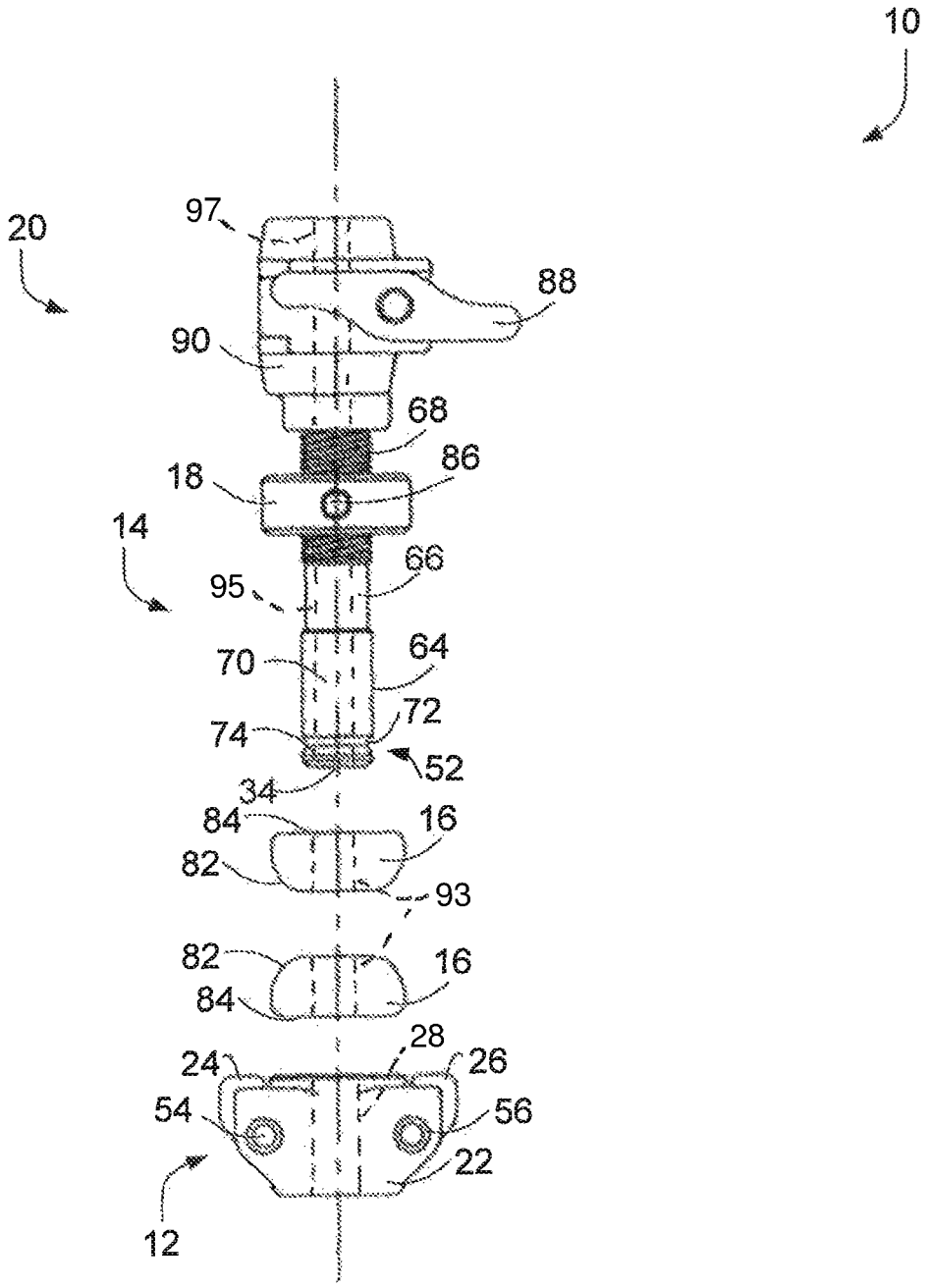
FIG. 2 is an exploded view of the exemplary cymbal mounting assembly of FIG. 1.

At least one cymbal support 16 is removably mounted onto the cymbal mounting shaft 14. In an exemplary embodiment, one cymbal support 16 can be disposed below the cymbal 76 and one cymbal support 16 can be disposed above the cymbal 76 when a cymbal 76 is mounted onto the cymbal mounting shaft 14. While two cymbal supports 16 are illustrated in FIGS. 1 and 2, one of ordinary skill in the art would recognize that only one cymbal support 16 can be implemented in the cymbal mounting assembly 10. For example, one cymbal support 16 can be disposed between the cymbal 76 and a positioning device 18. The at least one cymbal support 16 can have any size or shape and when two or more cymbal supports 16 are implemented, each cymbal support 16 can have the same size or shape or a size or shape different from each another cymbal support 16. For example, as illustrated in FIGS. 1 and 2, the cymbal supports 16 are rubber washers having a rounded surface 82 and a planar surface 84. However, other size and shapes can be implemented such as washers, rings, grommets, etc. In an exemplary embodiment, the rounded surface 82 of each cymbal support 16 can be arranged adjacent to the cymbal 76 to allow the cymbal 76 to vibrate within a range to create adequate resonance. The at least one cymbal support 16 can be made of various materials such as felt, wool, rubber, etc., and need not be separate parts, but can be integral with the housing 22 or the nut 18.

A positioning device 18 is threaded onto the threaded portion 68 of the cymbal mounting shaft 14 so as to be adjustable along an axis A of the shaft 14 to allow for adjustable positioning a cymbal 76 mounted onto the cymbal mounting shaft 14. In an exemplary embodiment, the positioning device 18 is a tension nut having a locking mechanism 86, such as an allen screw lock setting, where the positioning device 18 is threaded onto the threaded portion 68 of the cymbal mounting shaft 14 to the selected position and then a device such as an allen wrench is used to lock the positioning device 18 in place. By locking the positioning device 18 in place, undesired displacement of the positioning device 18 can be prevented when a force is applied to the cymbal. The positioning device 18 allows for cymbals 76 of various sizes, shapes, and thicknesses to be mounted to the cymbal mounting shaft 14. One of ordinary skill in the art would appreciate that any type of positioning device 18 can be implemented provided that the positioning device 18 is adjustably mounted to the cymbal mounting shaft 14 to accommodate cymbals 76 of various sizes, shapes, and thicknesses. Moreover, the locking mechanism 86 further reduces the likelihood of any undesirable displacement of the cymbal 76 due to the threaded coupling between the positioning device 18 and the threaded portion 68 of the shaft 14 because the locking mechanism 86 engages the shaft 14 to reduce any undesirable loosening or "backing-off" caused by the vibration after a force is applied to the cymbal 76.

An assembly connector 20 is coupled to the cymbal mounting shaft 14 and includes a securing element 88 and a fastening device 90. In an exemplary embodiment, the securing element 88 of the assembly connector 20 is a wing nut and the fastening device 90 of the assembly connector 20 is a conventional hinged clamp having an adjustable diameter. The securing element 88 can be rotated to adjust the inner diameter of a fastening device 90 where the fastening device 90 is disposed on an instrument stand shaft 92 and the inner diameter of the fastening device 90 is reduced to clamp with and secure the cymbal mounting assembly 10 to the instrument stand shaft 92. Thus, to receive the instrument stand shaft 92, with reference to FIG. 2, the quick release locking mechanism 12 has the housing 28 there-through, each of the cymbal supports 16 has a bore 93 there-though, the cymbal mounting shaft 14 has a shaft bore 95 there-through, and the connector assembly 20 has a connector bore 97 there-through. The bores 28, 93, 95 and 97 are aligned along axis A to permit the shaft 92 to pass there-though. In an alternative embodiment, the assembly connector 20 can be omitted from the cymbal mounting assembly 10 where the instrument stand 92 is directly coupled to the cymbal mounting shaft 14.

In operation, when the assembly connector 20 is locked to the shaft 92 and when the quick release locking mechanism 12 is in the locked position, as illustrated in FIGS. 1 and 4, the protrusion 44 of the proximal coupling portion 38 of each locking element 24, 26 is engaged with the annular groove 52 of the cymbal mounting shaft 14. It is noted that while the quick release locking mechanism 12 is prevented from displacement in the vertical or horizontal directions along with the cymbal mounting shaft 14, the quick release locking mechanism 12 may be rotatable around the axis of the cymbal mounting shaft 14 when the quick release locking mechanism 12 is in the locked position. To release the quick release locking mechanism 12 from the cymbal mounting shaft 14, the force F is applied to each of the locking elements 24, 26. In an exemplary embodiment, a force is simultaneously applied to the distal release portion 40 of both the first locking element 24 and the second locking element 26 causing each locking arm 36 to pivotally rotate around the pin 54 thereby disengaging the proximal coupling portion 38 of each locking element 24, 26 from the annular groove 52. When a force is not applied simultaneously to the first locking element 24 and the second locking element 26 such as when no additional force is applied to the locking elements 24, 26 or a force is applied to only one of the locking elements 24, 26, the quick release locking mechanism 12 remains engaged such that the quick release locking mechanism 12 is not separated from the cymbal mounting shaft 14.

Thereafter, to remove the cymbal mounting assembly 10 from the instrument stand shaft 92, the securing element 88 is rotated to increase the diameter of the fastening device 90 and the cymbal mounting assembly 10 can be lifted off of the instrument stand shaft 92.

The above-described cymbal mounting assembly 10 can be used in various cymbal arrangements. For example, as illustrated in FIGS. 1 and 2, cymbal mounting assembly 10 can be oriented such that the quick release locking mechanism 12 is disposed below a cymbal 76 and assembly connector 20. For instance, when the cymbal mounting assembly 10 is used with a dual cymbal assembly such as a hi-hat, the quick release locking mechanism is arranged below the assembly connector 20 on the instrument stand shaft 92. Alternatively, for various single cymbal assemblies such as crash, ride, splash, or china cymbals, the quick release locking mechanism 12 can be arranged above the assembly connector 20 on the instrument stand shaft 92. However, it is noted that the cymbal mounting assembly 10 can be used in any orientation for any cymbal assembly (e.g., above or below the cymbal 76). In an exemplary embodiment, when the cymbal assembly is a hi-hat cymbal assembly including a drop clutch, the drop clutch can be formed to be integral with the assembly connector 20 or mounted as a separate element separate from assembly connector 20. In addition, shaft 14 would be separate from the assembly connector 20 when a drop clutch is introduced to the hi-hat cymbal assembly.

FIGS. 5-9 illustrate a cymbal mounting assembly 10' according to another exemplary embodiment of the present invention. The same reference numbers have been used to indicate similar elements as the cymbal mounting assembly 10 illustrated in FIGS. 1-4.

As illustrated in FIGS. 7 and 8, the quick release locking mechanism 12' is generally inverted as compared to the embodiment of FIGS. 1 and 2. In addition, as shown in FIGS. 7 and 8, the protrusion 44' of the proximal coupling portion 38 can include a rounded surface 158, a first planar surface 160, and a second planar surface 162 where the rounded surface 158 connects the first planar surface 160 with the second planar surface 162. However, one of ordinary skill in the art would recognize that the protrusion 44' associated with the locking arms 24', 26' illustrated in FIGS. 7 and 8 could have any shape provided that the protrusion 44' includes a first surface (e.g., the first planar surface 160) that couples with the cymbal mounting shaft 14' such that the first surface and the first portion 152 interact to prevent the quick release locking mechanism housing 22 from disengaging from the cymbal mounting shaft 14' when the protrusions 44' engage with the groove 52' formed in the cymbal mounting shaft 14'.

As best illustrated in FIGS. 7 and 8, the quick release locking mechanism housing 22 of the quick release locking mechanism 12' includes a stepped bore having a first portion 130 and a second portion 132 where the diameter of the first portion 130 of the bore greater than a diameter of a second portion 132 of the bore.

In operation, the cymbal mounting shaft 14' is inserted into the first portion 130 of the bore in the quick release locking mechanism housing 22. Surface 34 engages the protrusion 134 formed in the shaft receiving wall 30. In addition, the protrusions 44' of each locking element 24', 26' engage with the groove 52' formed in the cymbal mounting shaft 14' where the first planar surface 160 engages with the first wall 152 of the annular groove 52' thereby preventing the quick release locking mechanism 12' from prematurely disengaging from the cymbal mounting shaft 14'.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A cymbal mounting assembly, comprising:

a cymbal mounting shaft having an annular groove formed in an outer surface of the shaft, wherein the cymbal mounting shaft is configured to receive a cymbal; and a quick release locking mechanism removably coupled to the cymbal mounting shaft, the quick release locking mechanism comprising:

a housing, a pair of locking elements movable with respect to the housing, each locking element including a proximal coupling portion and a distal release portion, wherein the proximal coupling portion of each locking element engages the annular groove formed in the outer surface of the shaft when the quick release locking mechanism is in a locked position.

2. The cymbal mounting assembly of claim 1, wherein the annular groove comprises a first angled surface and a second angled surface such that the groove is V-shaped.

3. The cymbal mounting assembly of claim 2, wherein each proximal coupling portion comprises a protrusion and each protrusion is disposed within the annular groove when the quick release locking mechanism is in the locked position.

4. The cymbal mounting assembly of claim 3, wherein each protrusion has a third angled surface and a second angled surface forming an apex that fits within the annular groove.

5. The cymbal mounting assembly of claim 1, wherein the quick release locking mechanism further comprises a compression spring associated with each locking element such that the proximal coupling portion of each locking element is biasingly engaged with the annular groove when the quick release locking mechanism is in the locked position.

6. The cymbal mounting assembly of claim 1, further comprising at least one cymbal support on the shaft, wherein the cymbal support is configured to support the cymbal.

7. The cymbal mounting assembly of claim 6, wherein a pair of the cymbal supports is provided and each support is composed of is a rubber, felt, or wool gasket.

8. The cymbal mounting assembly of claim 7, further comprising a positioning nut movably threaded onto the cymbal mounting shaft, wherein one cymbal support is in contact with the positioning nut and the other cymbal support is in contact with the housing.

9. The cymbal mounting assembly of claim 1, further comprising an assembly connector configured to removably couple the cymbal mounting assembly with an instrument stand shaft.

10. The cymbal mounting assembly of claim 1, wherein the outer surface of the shaft associated with the annular groove is smooth.

11. The cymbal mounting assembly of claim 1, wherein the annular groove comprises a first wall, a second wall substantially perpendicular to the first wall, and a third wall angled from the first wall.

12. A cymbal mounting assembly, comprising:

a cymbal mounting shaft having an annular groove formed in an outer surface thereof, wherein the cymbal mounting shaft is configured to receive a cymbal;

a positioning device movably coupled to the shaft so as to be adjustable along an axis of the shaft, and a quick release locking mechanism removably coupled to the cymbal mounting shaft, the quick release locking mechanism comprising:

a housing, locking structure movable with respect to the housing and including at least a proximal coupling portion and a distal release portion, wherein when a cymbal is received by the shaft between the positioning device and the quick release locking mechanism and when the proximal coupling portion is disposed in the annular groove defining a locked position of the locking structure preventing the quick release locking mechanism from moving along the axis of the shaft, the cymbal is secured between the quick release locking mechanism and the positioning device on the shaft, and wherein, when the distal release portion is manually engaged to remove proximal coupling portion from engagement with the annular groove, the quick release locking mechanism can be moved along the axis of the shaft.

13. The cymbal mounting assembly of claim 12, wherein the positioning device is a nut threadedly engaged with the shaft.

14. The cymbal mounting assembly of claim 12, further comprising first and second cymbal supports disposed on the shaft, with the first support being adjacent to the positioning device and the second support being adjacent to the housing of the quick release locking mechanism so that the cymbal can be sandwiched between the first and second supports when the cymbal is disposed on the shaft.

15. The cymbal mounting assembly of claim 12, wherein the locking structure comprises a pair of locking elements, each locking element including a proximal coupling portion and a distal release portion.

16. The cymbal mounting assembly of claim 12, further comprising an assembly connector associated with the shaft, each of the shaft, housing and assembly connector having a bore there-through constructed and arranged to receive a shaft of an instrument stand, the assembly connector being constructed and arranged to removably couple the cymbal mounting assembly with the shaft of the instrument stand.

17. The cymbal mounting assembly of claim 15, wherein the quick release locking mechanism further comprises a compression spring associated with each locking element such that the proximal coupling portion of each locking element is biasingly engaged with the annular groove when in the locked position.

18. The mounting assembly of claim 12, wherein the annular groove is provided at an end of the shaft.

19. A method of releasably mounting a cymbal with respect to a cymbal mounting shaft, the method comprising the steps of:

providing a cymbal mounting assembly having a cymbal mounting shaft including an annular groove formed in an outer surface of the mounting shaft and a shaft bore through the mounting shaft, coupling a positioning device to the mounting shaft so as to be adjustable along an axis of the mounting shaft, providing a cymbal on the outer surface of the mounting shaft so as to be generally adjacent to the positioning device, providing a quick release locking mechanism including a housing with a housing bore there-through and including locking structure having a proximal coupling portion and a distal release portion, and coupling the quick release locking mechanism to the mounting shaft so that the cymbal is secured between the positioning device and the quick release locking mechanism with the proximal coupling portion being disposed in the annular groove defining a locked position of the locking structure preventing the quick release locking mechanism from moving along the axis of the mounting shaft, wherein manual movement of the locking structure away from the annular groove permits the quick release locking mechanism to move from the locked position and be disengaged from the mounting shaft.

20. The method of claim 19, further comprising:

manually engaging the distal release portion of the locking structure to move the proximal coupling portion away from the annular groove, and manually moving the quick release locking mechanism along the axis of the mounting shaft to disengage with the mounting shaft.

21. The method of claim 20, wherein the locking structure comprises a pair of locking elements, each locking element including a proximal coupling portion and a distal release portion, and wherein the manually engaging step includes manually engaging the distal release portions substantially simultaneously to remove each proximal coupling portion from the annular groove.

22. The method of claim 19, further comprising:

inserting a shaft of a musical instrument stand through the shaft bore and the housing bore, and securing the cymbal mounting assembly to the shaft of the musical instrument stand.

* * * * *